United States Patent [19]

Arbuckle

[11] Patent Number: 4,922,719

[45] Date of Patent: May 8, 1990

[54] FLUIDIC TRANSFORMER WITH SEALED CYLINDER AND CHECK VALVES IN PISTONS

[76] Inventor: Donald P. Arbuckle, S. Vrain St., Denver, Colo. 80236

[21] Appl. No.: 112,663

[22] Filed: Oct. 26, 1987

[51] Int. Cl.[5] ..... F04B 5/00

[52] U.S. Cl. ..... 60/562; 60/564; 60/579; 60/585; 92/182; 417/245

[58] Field of Search ..... 60/549, 562, 564, 567, 60/579, 581, 585, 593; 92/86.5, 182; 91/520; 417/245, 260, 383

[56] References Cited

U.S. PATENT DOCUMENTS

| | | | |
|---|---|---|---|
| 2,876,625 | 3/1959 | Schnell | 60/564 X |
| 2,920,451 | 1/1960 | Milster | 60/564 |
| 2,974,493 | 3/1961 | Hawley | 60/564 |
| 3,355,887 | 12/1967 | Balster | 60/562 |
| 3,561,215 | 2/1971 | Krusemark | 60/562 X |
| 4,505,115 | 3/1985 | Arbuckle | 60/562 |

FOREIGN PATENT DOCUMENTS

| | | | |
|---|---|---|---|
| 861721 | 2/1941 | France | 92/182 |

*Primary Examiner*—Robert E. Garrett
*Assistant Examiner*—George Kapsalas
*Attorney, Agent, or Firm*—Matthews & Branscomb

[57] ABSTRACT

An improved fluid transformer which is capable of controlling the position of the operating pistons within the apparatus so that pressure equilibrium is maintained and the movements of the pistons are limited to predetermined locations within the cylinders. The transformer is capable of operating in a contaminated environment by purging unwanted fluid contamination from the internal workings of the transformer. Dynamic piston and cylinder seals are positioned such that destructive pressure forces are counteracted by opposite frictional forces during operation, thereby allowing the seals to remain effective at high pressures for long periods of time.

13 Claims, 3 Drawing Sheets

FLUIDIC TRANSFORMER WITH SEALED CYLINDER AND CHECK VALVES IN PISTONS

BACKGROUND OF THE INVENTION

1. Field of the Invention

The present invention relates generally to fluid hydraulic devices and methods of sealing high pressure fluids. Specifically, the present invention provides a fluid apparatus for transforming the magnitude of an input or applied pressure to at least one output or supply pressure, which pressure is a predetermined multiple or fraction of the input pressure. Using the design of the present invention, each of the individual seal elements in the transformer experiences a pressure differential which is a predetermined constant fraction of the total input pressure, thereby allowing the total number of seals to remain effective against very high pressures over a long period of time.

2. DESCRIPTION OF THE PRIOR ART

In the field of fluid hydraulics, the need for pressure intensifiers and reducers is well known. One type of pressure intensifier utilizes mechanical elements which act on the hydraulic fluid to increase its energy content and pressure. This type of pressure reducer is based on a pressure regulator which utilizes external mechanical control elements to absorb or control the flow rate of the hydraulic fluid in order to reduce its energy content and pressure.

Another well known type of pressure intensifier or reducer involves an assembly of pistions in which each piston includes at least two opposing surfaces of different surface areas. By applying pressure to the smaller surface, the resulting force on the pistion creates a reduced force at the larger surface. Conversely, by applying pressure to the larger surface, an increased pressure results at the smaller surface. Piston-type intensifiers and reducers have the advantage of preserving the energy content of the fluid while inherently performing pressure amplification or reduction. Piston-type intensifiers and reducers are preferred over the other types of devices involving external control elements because of the reliability and predictablility associated with their operation.

To obtain multiple increments of pressure reduction or intensification requires the use of multiple separate pistons serially connected together. Each piston in the series operates independently of the others, and each receives its input pressure from the preceding piston and supplies its output pressure to the following piston. Each piston in the series therefore creates its own independent influences on the total performance of the system. Because of the serial connection and the independent influences of each, some difficulty exists in obtaining certain desired and controllable effects such as predetermined pressure increments across the seal elements used in the series.

In the field of fluid seal assemblies, which are used for sealing static or dynamically moving parts against the application of pressure differentials, there are no known reliable and economic seal elements which remain effective against the application of extremely high pressure differentials. Seal failure is directly related to the magnitude of the pressure differential which the seal must withstand. High pressure seals typically fail after relatively short periods of use because they are charcteristically unable to withstand extremely high pressure differentials, particularly when relative movement between the seal element and one of the parts to be sealed is involved. Even when a plurality of seals are ganged or connected together, the majority of the pressure is typically withstood by only one seal of the group.

One solution to the above-discussed problems is shown in U.S. Pat. No. 4,505,115, owned by the applicant of this invention and which, by this reference, is incorporated for all purposes. The hydraulic system shown in this Patent is capable of supplying a plurality of increments of intensified or reduced pressures on a static or a dynamic operating basis wherein each incremental pressure is operatively related to the other incremental pressures and to the input reference pressures by previously unattainable relationships. In particular, the aforementioned invention provides an integrated pressure transformer and seal assembly wherein each of a plurality of seals is required to withstand a predetermined constant fraction of the applied pressure whereby the total number seals remain effective against very high pressures and over a relatively long period of use.

Despite the advantages and advancements provided by the above-referenced invention, a number of problems remained in actual operation of the system. One problem was unavoidable leakage across the seal boundaries which seal the pistons within the cylinders. This leakage occured both when the transformer was activated by an input pressure, and when the input pressure fluctuated, or changed in magnitude. This leakage caused movement of the pistons such that they drifted within the cylinders. As the fluctuation of pressure continued, the pistons began to drift to either end of the cylinder in which the pistons are housed. If the pistons drift to one end of each of the cylinders, the pistons are no longer in pressure equilibrium. Therefore there is no predetermined pressure created in the chambers, and the fluid transformer ceases to operate as a pressure-reducing system. Prior to the invention shown in the present application, there was no known method of correcting this problem.

Another problem with the operation of the prior fluid transformer sealing system was the introduction of contaminants; small particles, gases and corrosive fluid entering the inner workings of the fluid transformer, referred to as fluid contamination. The introduction of fluid contamination to the fluid transformer system is initiated by leakage of high pressure fluid into the lower pressure chambers of the fluid transformer during operation. The introduction of contaminated fluid into the fluid transformer system interferes with its creation of predetermined pressures. It does this in several ways: (1) Particles can become lodged between the surface of the piston and the surface of the cylinder, preventing movement of the piston to pressure equilibrium. The contaminated particles, if sufficiently hard, can scratch the piston and cylinder surfaces during piston movement. The surface scratches, particularly on the cylinder, can cause further fluid leakage, and consequent piston drift. Contaminated particles can also lodge between the seal and the cylinder, causing small scratches and abrasions in the seal material. Under high pressure conditions, these scratches and abrasions are easily made larger, resulting in immediate failure of the seal. Scratches in the walls of the cylinders as a result of contaminated particles introduced into the system, can also cause scratches and abrasions in the seal material. In either case, damage to seals causes sudden seal failure and will render the fluid transformer inoperable; (2) Gas contaminants are introduced into the fluid transformer system by leakage across the seal elements, and by the introduction of soluble gas in the hydraulic operating fluid. When the fluid in the transformer is reduced in pressure, and as the input fluid pressure drops, the gas becomes insoluble, creating bubbles in the chambers. The gas is compressible under high pressure, and therefore causes significant piston movement or drift to the extremities of the piston housing, rendering the system inoperable; (3) Fluid contaminants can also be introduced into the fluid transformer system by leakage across seal elements, similar to the introduction of gas contaminants. The fluid contamination can be corrosive, and depending on the nature of the contaminants, the seals can be dissolved over time; metals used in the contruction can become eroded oxidized or otherwise destroyed. Prior to the present invention, there was no known method of purging or otherwise removing contaminated solids, gases or fluids from the fluid transformer.

Another problem with the operation of the prior fluid transformer sealing system was the additional shearing force, or extrusive force on the seal elements sealing the large diameter pistons and cylinders, due to the location of the seal elements on the pistons. During operation the seals located on the large diameter pistons experience two types of destructive forces. One force is frictional, the other is a result of pressure acting on the seal. The frictional force occurs opposite to the direction of the pistons' movement as the pistons move toward the large-diameter end in attaining an equilibrium condition. The pressure force on the seal comes from the pressure developed on the large-diameter piston end, and is also in the opposite direction of the pistons' movement. Since both forces act on a large diameter piston seal in the same direction, both forces act together in extruding or shearing the seal. Prior to the present invention, there was no known configuration of the fluid transformer that could reduce the combination of these forces, such that they would not operate additively to destroy the large-diameter piston seal.

SUMMARY OF THE INVENTION

One of the objects of the present invention is to provide an improved fluid transformer which is capable of controlling the position of the operating pistons within the apparatus so that pressure equilibrium is maintained and the movements of the pistons are limited to predetermined locations within the cylinders. This feature prevents the pistons from drifting to the low pressure extremity of the cylinder, thereby allowing the transformer to operate without interruption.

Another object of the present invention is to provide a fluid transformer which is capable of operating in a contaminated environment by purging unwanted fluid contamination from the internal workings of the fluid transformer, keeping it clean and free of contaminated material which could interrupt piston movement, damage internal parts or cause seal failure.

Still another object of the present invention is to provide fluid transformer in which the dynamic piston and cylinder seals are positioned such that destructive pressure forces are counteracted by opposite frictional forces during operation, thereby allowing the seals to remain effective at higher pressure for a longer period of use.

In the invention fluid transformer which meets the above-mentioned objectivs, equilibrium on the pistons is maintained, thereby insuring the fluid transformer's operation while preventing damage to internal parts and seals, thereby utilizing higher pressure for a longer period of time under adverse conditions.

In the present invention, the output, or supply pressures are used in the construction of the transformer such that the seal elements incorporated within the design experience a pressure differential of a fraction of the total input pressure. The output or supply pressures developed by the prssure transformer can be applied to a separate high pressure seal packing such that the seal packing is designed with a series of seal elements. Each seal element in the packing is separated from another by a fluid gland or chamber, which is connected to the output or supply pressures from the fluid transformer, in such a way that successive pressure magnitudes are increased serially across the elements. Therefore, each seal element has a smaller pressure differential than the total pressure, thereby achieving a higher overall pressure sealing capability for both rotating and reciprocating service.

One of the important features of the pressure transformer of the present invention apparatus is a combination of springs and check valves which work together to position the operating pistons within the device such that the movements of the pistons are controlled or limited to a predetermined location within the cylinders. The process of correcting the piston location occurs when there is no applied input pressure to the system. When this occurs, check valves are open between each successive pressure chamber, and springs located on the piston end surfaces relocate the pistons to their initial positions by exerting force on one or more of the piston surfaces, causing the piston to be moved to it's initial position within the cylinder. This improvement confines the movements of the pistons to a predetermined location within cylinders.

Another important feature of the present invention relates to the connection of a fluid reservoir to the lowest pressure chamber of the fluid transformer by means of a metering valve and a check valve. The supply fluid purges the fluid transformer by opening the check valve connected between the supply pressure and the low pressure chamber, and the check valves located between each successive higher pressure stage of the transformer, supplying clean fluid and purging unwanted fluid contaminants and gases from the internal workings of the fluid transformer apparatus. The operation of the above described purging system occurs when there is no applied input pressure to the transformer system.

Another important feature of the invention fluid transformer is the location of seal elements within the walls of the piston cylinders. When the fluid transformer is activated by a pressure input, the seals are pressure-activated. In other words, they expand and exert radial force on the pistons and cylinders simultaneously. When the pistons in the fluid transformer move due to the force acting on them by the fluid pressure within the system, a frictional force acts on each seal element located in the cylinder in an axial direction, and in the same direction as the movement of the piston (the opposite is ture if the seal is mounted on the piston). The fluid pressure also exerts a force on each seal element. This configuration locates the seals in the transformer so that force of fluid pressure upon the seals counteracts either the piston or cylinder, and is opposite to the force of friction on the seals.

The present invention is defined by the scope of the appended claims. A more complete understanding of the features of the present invention, as well as other objectives, improvements and advantages, is available from the following detailed description of preferred embodiments taken in conjunction with the drawings.

DETAILED DESCRIPTION OF THE PREFERRED EMBODIMENT

Figure 1:
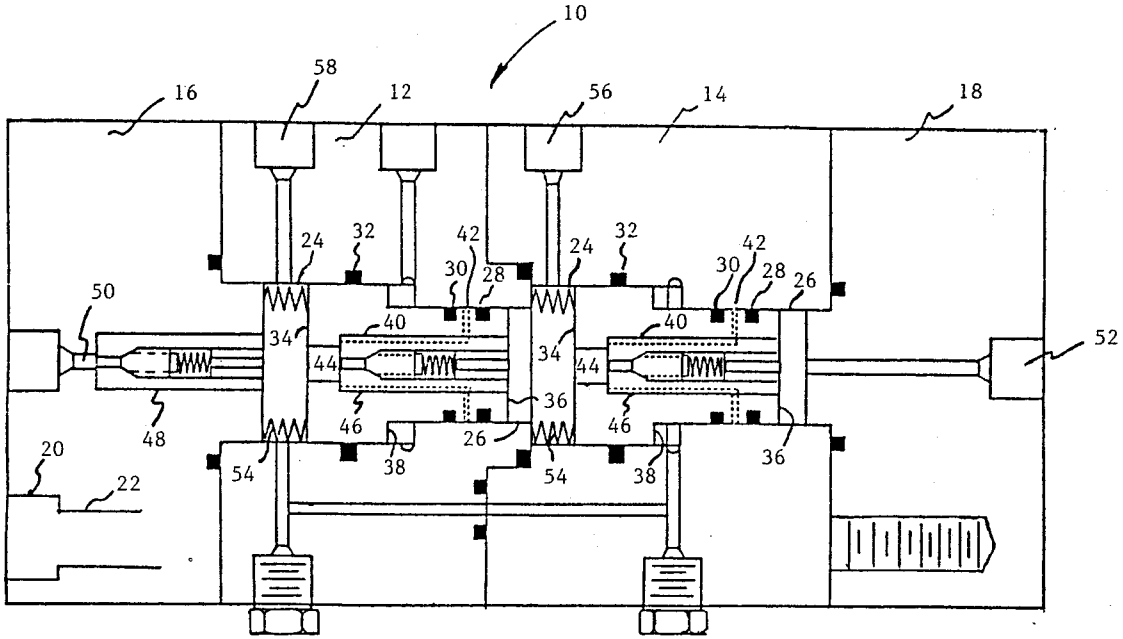
FIG. 1 is a mechancial representation of the major system components of a two-stage, two-piston fluid transformer of the present invention.

Some of the basic features and operation present invention can be seen by referring to FIG. 1. As shown in FIG. 1, the fluid transformer and improvements 10 comprise a first piston P1 and a second piston P2, retained for movement within a housing. The housing of the two-piston transformer 10 is defined by two annularly-shaped middle segments 12 and 14, which are held in serially-assembled order between oppositely opposed end caps 16 and 18 by a plurality of bolts 20, extending through axially extending appertures 22 formed in the end cap members and the middle segments. The bolts 20 are threaded into a threaded receptacle on the end cap member 18. The appertures 22 and the bolts 20 are positioned at spaced circumferential intervals, not to interfere with the other elements of the fluid transformer. A significant number of bolts are provided to withstand the working pressures applied to and created in the transformer 10. The middle segments 12 and 14 are of generally similar configuration, thereby allowing as many middle segments as are desired to be assembled in serial order. By this arrangement, fluid transformers using any number of pistons are easily assembled.

Each middle segment 12 and 14 is formed with a large diameter opening 24 and a small diameter opening 26. The openings 24 and 26 in each segment 12 and 14 extend coaxially about the axis of the housing of the transformer 10. Pistons P1 and P2 are respectively positioned for sliding movement within the openings 24 and 26 in the middle segments 12 and 14 respectively. An annular piston seal 28 is carried by each piston, and is positioned adjacent to the outside end of the small end of each piston P1 and P2, and seals against the pressure in opening 26. Another annular seal 30 extends around the small end of each piston and seals fluid pressure from port 42 between seal 28 and seal 30. A large annular seal 32 is mounted in each cylinder 12 and 14 and seals each piston against the large openings 24. The seals 28, 30 and 32 operatively seal each piston for movement in openings 24 and 26. Seals 28, 30 and 32 are located in such a way as to minimize the shearing force on each seal caused by a combination of fluid pressure and sliding friction. The location of seals 28, 30 and 32 cause the frictional force in each seal to be opposite the force caused by pressure on each seal if the transformer is activated by pressure in port 52, moving the pistons P1 and P2 into chambers 24. The counteracting forces of friction and pressure reduce the shearing stress created in each seal, thereby improving the ability of the pressure transformer to withstand higher pressure.

This particular seal location, shown in FIG. 1, is best utilized when the pressure transformer is being used as a pressure reducer. When the fluid transformer is being used as a pressure intensifier, seals 28 and 30 are located in the cylinder wall of chamber 26, and seal 32 is located on the large diameter end of pistons P1 and P2 (not shown). These seal locations insure opposing frictional and pressure forces on the seals during fluid transformer application as a pressure intensifier.

Each piston has a large end surface 34 and a small end surface 36 and a second small surface 38 on the underside of the large piston end opposite the large surface 34. The areas of the surfaces 34, 36 and 38 extend virtually perpendicular to the axis of the pistons.

An annularly extending port 40 supplies pressure between seals 28 and 30, and extends through each piston member connecting holes 42 and 44. Hole 42 extends from the port 40 to an area between seals 28 and 30. Hole 44 connects port 40 to opening 24. Hydraulic fluid in opening 24 adjacent to the large piston end 34 is communicated through the hole 44 and annular port 40 and through hole 42 to the area between the seals 28 and 30. The purpose of the port 40 and holes 42 and 44 is to maintain equivalent pressure differentials across each piston seal 28 and 30 when the the transformer 10 is activated by pressure in port 52.

Each piston contains axially located check valves 46. These check valves are oriented such that fluid is allowed to flow from opening 24 through hole 44 and check valve 46 to opening 26 for each piston. Another check valve 48 is located axially in end cap 16 and is oriented such that fluid from a reservoir (not shown) is allowed to flow into the pressure transformer 10 from port 50. The combination of the piston check valves 46 and the end cap check valve 48 allows flow through pressure transformer 10 from port 50 through chambers 24 and 26 and into port 52. This flow is referred to as the purging phase of the fluid transformer. When pressure is developed in port 52 from an outside source, the pressure transformer is activated and intermediate pressures are created within the transformer apparatus. This is referred to as the activation phase of the fluid transformer. Different applications of the fluid transformer require different cycles of operation for both the purging phase and the activation phase, as will be described later.

Located in the cylindrical chamber 24 and in between the blind end of chamber 24 and the large diameter end of each piston are annularly-shaped springs 54. The springs can be constructed using several different methods, for example using a series of Belleville springs as shown in FIG. 1, or a coil construction, or a solid elastic polymer construction (the construction of the springs must allow for the flow of fluid from chambers 24 to connecting ports 56 and 58). The springs 54 are used for repositioning pistons P1 and P2 to the innermost locations within the chamber 26 when the pressure transformer is in the purging phase. When this occurs, the pistons P1 and P2 are moved by the springs 54 into the chamber 26 in the same direction of the fluid flow through the check valves. The use of springs for repositioning the pistons P1 and P2 are important in allowing the fluid transformer to operate continuously by keeping the pistons in fluid equilibrium during the activation phase.

Figure 2A:
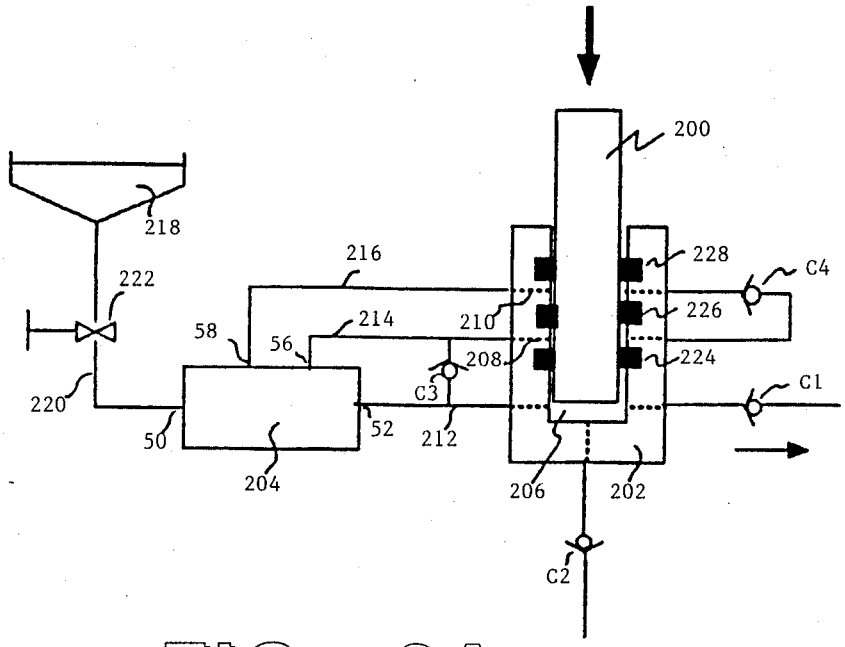
FIGS. 2*a* and 2*b* are schematic illustrations of the present invention connected to and working with a high pressure piston pump packing.
Figure 2B:
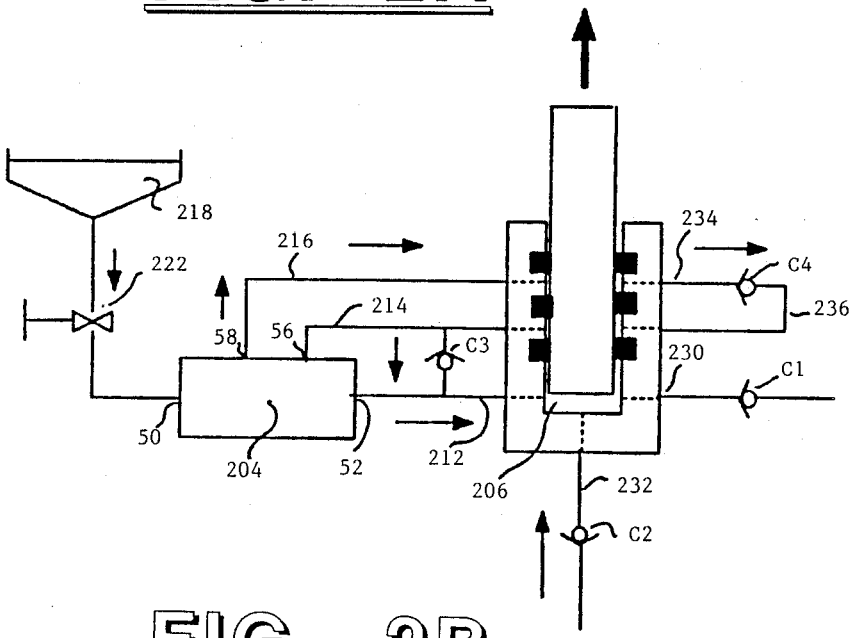

The apparatus illustrated in FIGS. 2*a* and 2*b* incorporates a two-piston fluid transformer, similar to the two-piston transformer shown in FIG. 1 described above, as an integral part of a high pressure piston shaft used for pumping high pressure fluid. Ports 50, 52, 56, and 58 shown on the fluid transformer in FIGS. 2*a* and 2*b* are the same ports shown on the fluid transformer in FIG. 1. FIG. 2*a* shows a schematic drawing of an integrated fluid transformer and high pressure pump piston seal during the activation phase of operation of the fluid transformer and the power stroke of the pump piston. FIG. 2*b* shows a schematic drawing of an integrated fluid transformer and high pressure pump piston seal during the purging phase of operation of the fluid transformer and the suction stroke of the pump piston.

In FIG. 2*a* a pump piston 200 is shown moving into a cylinder 202, creating a high pressure environment in chamber 206. Fluid ports 52, 56, and 58 of the two-piston fluid transformer 204 are connected to fluid chambers 206, 208, and 210 within cylinder 202 by conduits 212, 214 and 216. Fluid reservoir 218 is connected by means of a conduit 220 and a metering valve 222 to port 50 of the fluid transformer 204. Pressure developed in chamber 206 and port 52 by the movement of piston 200 activtes the fluid transformer 204. Successively lower pressures than that of chamber 206 are developed in ports 56 and 58 and chambers 208 and 210. The pressures in chambers 208 and 210 are $\frac{2}{3}$ and $\frac{1}{3}$ respectively of the pressure in 206 and are typical of a two-piston fluid transformer in the activation phase of operation. Three seals 224, 226 and 228 are mounted in the wall of cylinder 202 and seal fluid chambers 206, 208 and 210 around the piston. Each seal 224, 226 and 228 holds a differential pressure around the piston of $\frac{1}{3}$ the pressure in chamber 206. As the piston 200 continues to move into cylinder 202 fluid is pumped out of chamber 206, and in the direction of the small arrow, and through check valve C1 to a high pressure supply source (not shown ). Check valves C2, C3 and C4 shown in FIG. 2*a* remain closed until the pressure in chamber 206 is lowered in the suction cycle of pump operation.

In FIG. 2*b*, piston 200 is shown moving out of cylinder 202, creating a low pressure environment in chamber 206. Fluid connections between the fluid transformer and the shaft seal are the same connections as described in 2*a* above. However, unlike FIG. 2*a*, check valves C2, C3, C4 and check valves 46 and 48 in the fluid transformer remain open check valve C1 is closed. The low pressure created in chamber 206 causes fluid to flow into chamber 206 through conduits 212 and 232. Fluid flowing into chamber 206 from conduit 212 is supplied from reservoir 218. Fluid from reservoir 218 flows through conduit 220 and metering valve 222 and through the fluid transformer 204 through check valves 46 and 48 and into conduit 212. Fluid also flows into conduit 212 and chamber 206 by means of conduits 216,234,236,214 and check valves C4 and C3. Check valves C4 and C3 are connected in the same direction and between the same common chambers 208 and 210 as check valves 46 in the fluid transformer, and provide fluid flow through chambers 210 and 208, purging the shaft area of the system. Flow through the system is illustrated by the small arrows in FIG. 2*b*. Fluid flowing into chamber 206 from conduit 232 through check valve C2 supplies the main input source of pumping fluid from a pumping fluid reservoir (not shown). The pumping fluid may have contamination in the form of suspended solids and abrasive particles. The quantity of fluid moving through conduit 232 is much larger than that which moves through 212. The pump pumps both purging fluid supplied from conduit 212 and pumping fluid supplied from conduit 232. The quantity of purging fluid pumped into chamber 206 is controlled by the flow metering valve 222.

During the power stroke of the pump cycle and the activation phase of the fluid transformer, the pump packing and the fluid transformer work together to seal the highest possible pressure for the longest period of time without seal failure. The fluid transformer supplies lower pressure increments to the pump packing seals, reducing the failure force on each seal element in the packing, while supplying additional lubrication to each seal element within the packing. When the pump cycle changes to the suction stroke, pressure is reduced inside the pump and the fluid transformer, allowing the fluid transformer and pump packing chambers to be purged of contaminated fluid, and allowing the pistons within the fluid transformer to adjust their positions. Cooling also occurs to the packing area as a result of purging fluid. The purging and adjustment of pistons every pump cycle maintains long, uninterrupted operation of the integrated fluid transformer and piston pump packing.

Figure 3A:
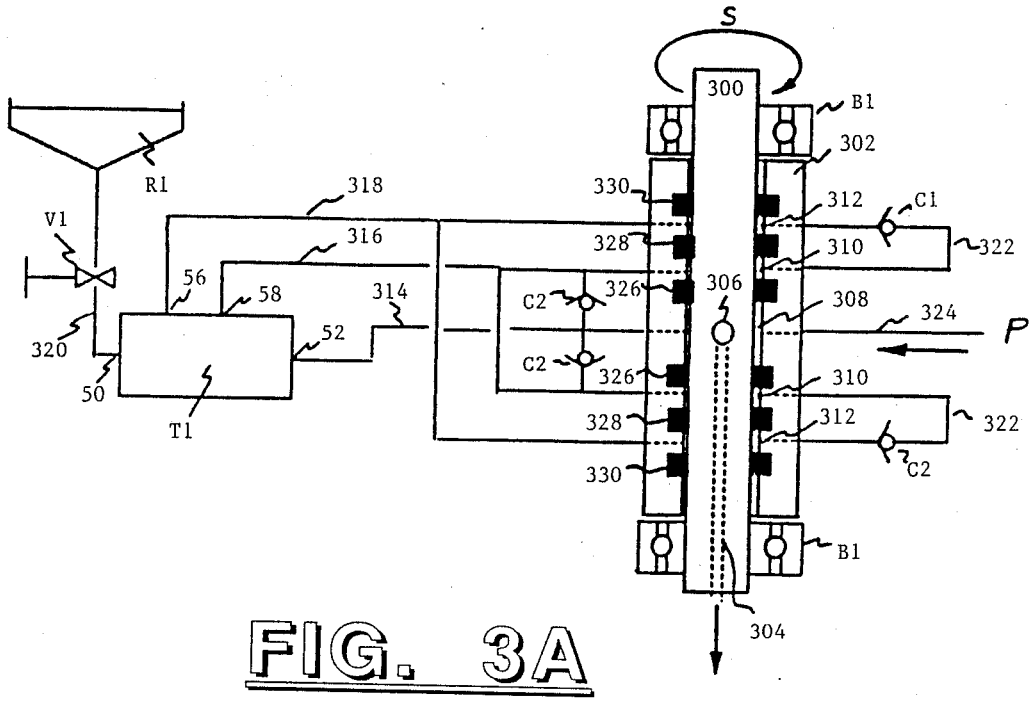
FIGS. 3*a* and 3*b* are schematic illustrations of the present invention connected to and working with a high pressure rotary swivel.
Figure 3B:
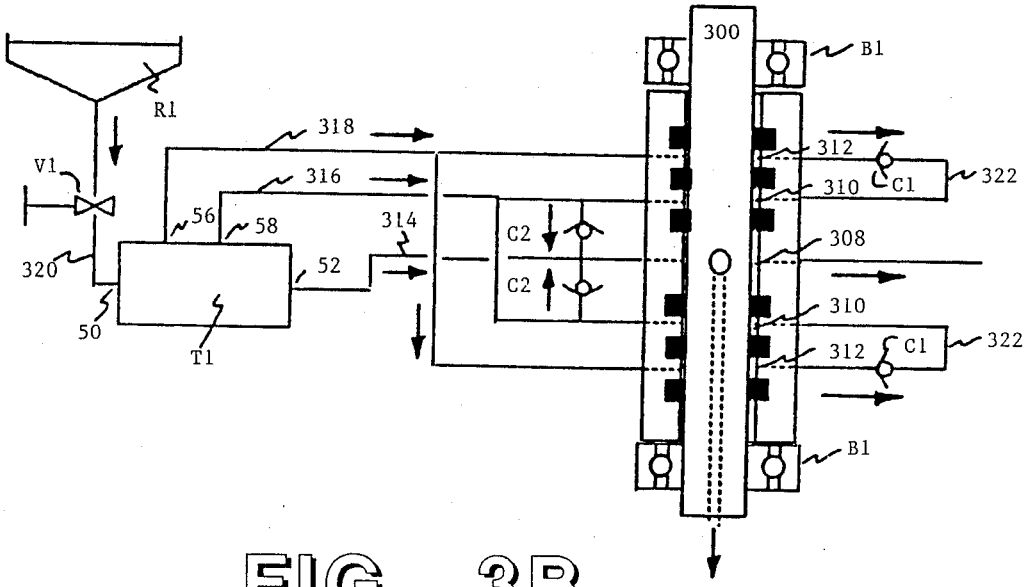

The apparatus illustrated in FIGS. 3*a* and 3*b* incorporates a two-piston fluid transformer, similar to the two-piston transformer shown in FIG. 1 described above, as an integral part of a high pressure rotary shaft seal or swivel. Ports 50, 52,56 and 58 shown on the fluid transformer in 3*a* and 3*b* are the same ports shown on the fluid transformer in FIG. 1. FIG. 3*a* shows a schematic drawing of an integrated fluid transformer and high pressure swivel during the activation phase of operation of the fluid transformer and the operation of the swivel. FIG. 3*b* shows a schematic drawing of an integrated fluid transformer and a high pressure swivel during the purging phase of operation of the fluid transformer and the idle state of the swivel. In FIG. 3*a*, a shaft 300 is rotated by an external mechanical power source S inside stationary cylinder 302. Shaft 300 has a center bore 304 through approximately one half of the shaft's length and another bore 306 perpendicular to the axis of shaft 300 and intersecting bore 304 in the middle of shaft 300. High pressure fluid supplied from an external pump P flows through conduit 324, and into and through chamber 308. From chamber 308 high pressure fluid flows into bore 306 in the rotating shaft 300 and through bore 304 to a rotating piece of hydraulic equipment (not shown) on the lower end of shaft 300. The small arrows shown in FIG. 3*a* illustrate the high pressure fluid flow through the swivel. The shaft 300 is mechanically confined on both ends with bearings B1 to rotate on a single axis. Fluid ports 52, 56, and 58 of the two-piston fluid transformer T1 are connected to fluid chambers 308,310,and 312 within cylinder 302 by conduits 314,316,and 318. Fluid reservoir R1 is connected by means of conduit 320 and metering valve V1 to port 50 of the fluid transformer T1. High pressure from external pump P and chamber 308 transfers pressure through conduit 314 to port 52 putting the fluid transformer T1 in the activation phase of operation. Successively lower pressures than that of chamber 308 are developed by the fluid transformer in ports 56 and 58 and chambers 310 and 312. The pressures in chambers 310 and 312 are $\frac{2}{3}$ and $\frac{1}{3}$ respectively of the pressure in chamber 308 and are common to a two-piston transformer in the activation phase of operation. Three seals 326, 328 and 330 mounted in the wall of cylinder 302 seal fluid in chambers 308,310 and 312 around the rotating shaft 300. Each seal 326, 328, and 330 holds a differential pressure of ⅓ the pressure in chamber 308. Check valves C1, C2, and check valves 46 and 48 in the fluid transformer remain closed in FIG. 3*a*.

In FIG. 3*b* shaft 300 is stopped from rotating and fluid from pump P has been shut off from the swivel. Pressure in chamber 308 falls to a lower pressure than that of fluid resvoir R1, and check valves C1, C2 and check valves 46 and 48 in the fluid transformer are opened by fluid reservoir R1 flowing into chamber 308. The low pressure created in chamber 308 causes fluid to flow into chamber 308 through conduit 314 and check valves C2. Fluid from reservoir R1 flows through conduit 320 and metering valve V1, and through the fluid transformer T1 through check valves 46 and 48, and into conduit 314. Fluid also flows from the transformer into conduit 314 and chamber 308 by means of conduits 318, 322, 316, and check valves C1 and C2. Check valves C1 and C2 are connected in the same direction and between the same common chambers 310 and 312 as check valves 46 in the transformer, and provided fluid flow through chambers 312 and 310, purging the shaft packing area. Flow through the system is llustrated by the small arrows in FIG. 3*b*. The amount of purging fluid flowing into chamber 308 is controlled by adjustment to metering valve V1. During the operation of the swivel and the activation phase of the fluid transformer, the swivel packing and the fluid transformer work together to seal the highest possible pressure for the longest period of time without seal failure. The fluid transformer supplies lower pressure increments to the swivel packing seals, reducing the failure force on each seal element in the packing, while lubricating and cooling each seal element. When the pressure supplied to the swivel is stopped, and pressure is reduced inside the swivel, the fluid transformer and swivel packing chambers are purged of contaminated fluid, and pistons within the fluid transformer adjust their positions. The purging and adjustment of pistons when the swivel is idle maintains long uninterrupted operation of the integrated fluid transformer and swivel seal packing.

Although the fluidic transformer of the present invention has been described in connection with the preferred embodiment, it is not intended to be limited to the specific form set forth herein, but, on the contrary, it is intended to cover such modifications, alternatives, and equivalents as can be reasonably included within the scope and spirit of the invention as defined by the apended claims.

I Claim:

1. A fluidic transformer operative with respective to a reference pressure for transforming an input pressure into at least one output pressure comprising:

means defining a plurality of pistons:

each said piston defining a large surface and two small surfaces, the two small surfaces oriented to each derive force from pressure applied thereto to move each piston in one direction in its reference movement path, the large surface oriented to derive force from pressure applied thereto to move each piston in the opposite direction in its reference movement path, each surface presenting an effective area which is defined by that amount of the actual area of the surface which is effective during pressure application to move the piston in its reference movement path, the effective area of the large surface of each piston being greater than the effective area of either of its small surfaces:

means operatively retaining each piston for reciprocative movement in a reference movement path associated with each piston: means for preventing drift of each said piston within said reference movement path, said means for preventing drift of each piston comprising means for biasing said piston toward a predetermined position within said reference movement path, said means for biasing each said piston comprising a spring means operating on said large surface of each said piston, said means for preventing drift further comprising valve means for regulating said communication of said reference pressures between said different surfaces of said pistons;

means communicating the reference to a surface of one piston:

means communicating the input pressure to a surface of another piston;

internal pressure communication means for directly communicating pressures between different surfaces of different pistons to create at least one internal pressure on at least one surface of at least one piston, the internal pressure defined substantially only by the magnitude of the input pressure relative to the reference pressure and a ratio of the effective areas of the surfaces of the piaton; and means for communicating the internal pressure as the output pressure.

2. The fluidic transformer according to claim 1, said valve means comprising a one directional check valve, said spring means restricting said piston's position to said predetermined location when said transformer is not activated by pressure.

3. The fluid transformer according to claim 2, said check valve being an intergral part of said piston.

4. A fluidic transformer as defined in claim 3, wherein said internal pressure communication means is operatively substantially only from pressures created at the piston surfaces by forces present on said plurality of pistons as a result of the reference and input pressures communicated to said surfaces of said pistons, and said internal pressure communication means communicates the internal pressure between the large surface of each piston and the small surface of another piston.

5. A fluidic transformer operative with respective to a reference pressure for transforming an input pressure into at least one output pressure comprising;

means defining a plurality of pistons;

means operatively retaining each piston for reciprocative movement in a reference movement path associated with each piston, said means for retaining each said piston comprising a plurality of cylinders adapted to receive said pistons therein;

fluidic sealing means for preventing the passage of fluid between the opposing faces of each said cylinder and said respective piston, said fluidic sealing means comprising an annular rod seal received in the surface of each said cylinder, said seals being positioned to cause the pressure forces created by the movement of said pistons to be counteracted by opposite frictional forces associated with movement of each said piston;

means for preventing drift of each said piston within said reference movement path;

each said piston defining a large surface and two small surfaces, the two small surfaces oriented to each derive force from pressure applied thereto to each move each piston in one direction in its reference movement path, the large surface oriented to derive force from pressure applied thereto to move each piston in the opposite direction in its reference movement path, each surface presenting an effective area which is defined by that amount of the actual area of the surface which is effective during pressure application to move the piston in its reference movement path, the effective area of the large surface of each piston being greater than the effective area of either of its small surfaces;

means communicating the reference pressure to a surface of one piston;

means communicating the input pressure to a surfce of another piston;

internal pressure communication means for directly communicating pressures between different surfaces of different pistons to create at least one internal pressure at least one surface of at least one piston, the internal pressure defined substantially only by the magnitude of the input pressure relative to the reference pressure and a ratio of the effective areas of the surfaces of the pistons; and means for communicating the internal pressure as the output pressure.

6. The fluidic transformer according to claim 5, said means for preventng drift of each piston comprising means for biasing said piston toward a predetermined position within said reference movement path.

7. The fluidic transformer according to claim 6, said means for biasing each said piston comprising a spring means operating on said large surface of each said piston.

8. The fluidic transformer according to claim 7, said means for preventing drift further comprising valve means for regulating said communication of said pressures between said different surfaces of said pistons.

9. The fluidic transformer according to claim 8, said valve means comprising a one directional check valve, said spring means restricting said piston's position to said predetermined location when said transformer is not activated by pressure.

10. A fluidic transformer as defined in claim 9, wherein said internal pressure communication means is operative substantially only from pressures created at the piston surfaces by forces present on said plurality of pistons as a result of the reference and input pressures communicated to said surfaces of said pistons, and said internal pressure communication means communicates the internal pressure between the large surface of each piston and the small surface of another piston.

11. A fluidic transformer operative with respect to a reference pressure for transforming an input pressure into at least one output pressure comprising:

means defining a plurality of pistons;

means operatively retaining each piston for reciprocative movement in a reference movement path associated with each piston, said means for retaining each said piston comprising a plurlity of cylinders adapted to receive said postions therein;

fluidic sealing means for preventing the passage of fluid between the opposing faces of each said cylinder and said respective piston;

means for preventing drift of each said piston within said reference movement path;

means for purging contaminants from fluid in pressure communication with said pistons;

each said piston defining a large surface and two small surfaces, the two small surfaces oriented to each derive force from pressure applied thereto to each move each piston in one direction in its reference movement path, the large surface oriented to derive force from pressure applied thereto to move each piston in the opposite direction in its reference movement path, each surface representing an effective area which is defined by that amount of the actual area of the surface which is effective during pressure application to move the piston in its reference movement path, the effective area of the large surface of each piston being greater than the effective area of either of its small surfacs;

means communicating the reference pressure to a surface of one piston;

means communicating the input pressure to a surface of another piston;

internal pressure communication means for directly communicating pressures between different surfces of different pistons to create at least one internal pressure on at least one surfce of a least one piston, the internal pressure defined substantially only by the magnitude of the input pressure relative to the reference pressure and a ratio of the effective areas of the surfaces of the pistons; and means for communicating the internal pressure as the output pressure.

12. The fluidic transformer according to claim 11, said fluidic sealing means comprising an annular rod seal received in the surface of each said cylinder, said seals being positioned to cause pressure forces created by the movement of said pistons to be counteracted by opposite frictional forces associated with movement of each said piston.

13. The fluidic transformer according to claim 12, said means for preventing drift of each piston comprising means for biasing said piston toward a predetermined piston within said reference movement path.

* * * * *